US006139006A

United States Patent [19]

Asada

[11] Patent Number: 6,139,006

[45] Date of Patent: Oct. 31, 2000

[54] SHEET FEEDER CAPABLE OF ELIMINATING OVERLAPPING SHEET FEED

[75] Inventor: Tetsuo Asada, Kuwana, Japan

[73] Assignee: Brother Kogyo Kabushiki Kaisha, Nagoya, Japan

[21] Appl. No.: 09/170,164

[22] Filed: Oct. 13, 1998

[30] Foreign Application Priority Data

Oct. 15, 1997 [JP] Japan ..... 9-281772

[51] Int. Cl.[7] ..... B65H 3/52

[52] U.S. Cl. ..... 271/121; 271/114; 271/109

[58] Field of Search ..... 271/121, 114, 271/109

[56] References Cited

U.S. PATENT DOCUMENTS

| | | | |
|---|---|---|---|
| 4,269,403 | 5/1981 | Stephens et al. | 271/114 X |
| 4,858,907 | 8/1989 | Eisner et al. | 271/124 |
| 4,871,162 | 10/1989 | Imai et al. | 271/122 X |
| 5,120,043 | 6/1992 | Marzullo | 271/117 |
| 5,208,626 | 5/1993 | Tanimoto et al. | 355/200 |
| 5,244,191 | 9/1993 | Kanekura | 271/10 |
| 5,552,900 | 9/1996 | Someya | 358/452 |
| 5,582,399 | 12/1996 | Sugiura | 271/10.11 |
| 5,584,475 | 12/1996 | Asada et al. | 271/121 |
| 5,659,863 | 8/1997 | Kawabata et al. | 399/303 |
| 5,934,664 | 8/1999 | Murayama et al. | 271/118 |
| 5,996,989 | 12/1999 | Cahill et al. | 271/121 |
| 6,022,015 | 2/2000 | Matsumoto | 271/121 |

FOREIGN PATENT DOCUMENTS

| | | | |
|---|---|---|---|
| 5-229682 | 9/1993 | Japan | 271/121 |
| 579264A1 | 1/1994 | United Kingdom | 271/121 |

*Primary Examiner*—Christopher P. Ellis
*Assistant Examiner*—Richard Ridley
*Attorney, Agent, or Firm*—Oliff & Berridge, PLC

[57] ABSTRACT

A sheet feeder provided in an image forming device and includes a sheet feed roller, a pair of collars provided at both ends of the sheet feed roller and rotatable independent of the sheet feed roller, and a separation pad provided in confronting relation to the sheet feed roller and the pair of collars. The sheet feed roller has a cylindrical roller having a diameter smaller than that of the collar and a roller shaft. An irregular diameter sleeve including first and second radius portions is mounted on the roller shaft, and the collar is loosely rotatable on the irregular diameter sleeve. The first radius portion has a first radius greater than a second radius of the second radius portion. When the first radius portion is angularly rotated to a position in confrontation with the separation pad, a distance between an axis of the roller shaft and the lower end of the collar is greater than the radius of the feed roller. When the second radius portion is angularly rotated to the position in confrontation with the separation pad, the lower end of the collar can be moved upwardly, so that the sheet feed roller can perform sheet nipping relative to the separation pad.

18 Claims, 7 Drawing Sheets

SHEET FEEDER CAPABLE OF ELIMINATING OVERLAPPING SHEET FEED

BACKGROUND OF THE INVENTION

The present invention relates to a sheet feeder provided in an image forming device such as a copy machine, laser printer, and facsimile machine, and more particularly, to a sheet feeder for feeding stacked sheets of a recording medium one sheet at a time.

A conventional sheet feeding device provided in image forming devices such as copy machines, laser printers, and facsimile devices is shown in FIGS. 10 and 11. This sheet feeding device is provided with a feed roller 101 for conveying a paper 102 and a separating pad 103 opposing the feed roller 101 such that the paper 102 is interposed between the feed roller 101 and separating pad 103. This sheet feeding device is well known in the art for separating and conveying each of a stack of paper 102 one sheet at a time. The separating pad 103 is embedded into a depression formed in a sheet receiving portion 105 of a separating pad holder 104. The separating pad holder 104 is urged toward the feed roller 101 by a spring 107 interposed between a fixed stop member 106 and the bottom surface of the sheet receiving portion 105. The feed roller 101 is formed of an elastic material in an approximate D-shape and includes a circumferential surface 108 for contacting and conveying the paper 102 and a cut-out surface 109 formed by cutting away a portion of the circumferential surface 108. Collars 110 are rotatably mounted on both ends of the feed roller 101. Both of the collars 110 are formed with a radius slightly smaller than the radius of the circumferential surface 108. Hence, when the circumferential surface 108 is conveying the paper 102, the collars 110 do not contact the paper 102. However, when the circumferential surface 108 has completed conveying the paper 102 and the cut-out surface 109 opposes the paper 102, the peripheral surface of the two collars 110 contact the paper 102 and oppose the urging force of the separating pad 103, thereby forming a space between the cut-out surface 109 and the paper 102 to prevent the cut-out surface 109 from contacting the paper 102.

Guide rollers 112 and 113 are positioned downstream of the feed roller 101 and convey the paper 102 after the circumferential surface 108 has completed conveying the paper 102. The cut-out surface 109 is separated a prescribed distance from the paper 102 by the two collars 110, thereby stopping driving of the paper 102. In addition, the collars 110 contact and rotate on the top surface of the paper 102, which is conveyed by the guide rollers 112 and 113, thereby allowing only one paper 102 to be conveyed at a time.

However, when conveying the paper 102, the circumferential surface 108 and the collars 110 contact the paper 102 and separating pad 103 at different positions, or heights, because the radius of the two collars 110 is smaller than the radius of the circumferential surface 108. This difference in radii creates a bump when the paper 102 and separating pad 103 change from contacting the collars 110 to contacting the circumferential surface 108 and vice versa, causing the separating pad 103 to move upward and downward.

When the separating pad 103 moves upward and downward, as described above, there is a tendency for a plurality of paper 102 to be fed simultaneously, causing doubles or partly overlapped sheets to be fed. In other words, when the paper 102 is first fed under the feed roller 101, the leading edge of the paper 102 contacts an entry contact portion 115 of the circumferential surface 108, which is the transition point from the collars 110 contacting the separating pad 103 to the circumferential surface 108 contacting the separating pad 103. Therefore, the separating pad 103 is moved downward. In this instant, the pressure on the paper 102 changes greatly, inviting a plurality of paper 102 to enter simultaneously between the circumferential surface 108 and separating pad 103, inviting the feeding of doubles or multiple sheets. Also, when the circumferential surface 108 has completed conveying the paper 102, an exit contact portion 114 of the circumferential surface 108 is the last part of the feed roller 101 to contact the paper 102 before the roller 110 come in contact with the paper 102. In the instant that the paper 102 separates from the circumferential surface 108, the separating pad 103 moves upward, causing a great change in pressure on the paper 102, inviting the next paper 102 or plurality of next paper 102 to be conveyed along with the paper 102 being conveyed between the guide rollers 112 and 113, inviting the feeding of partly overlapped sheets. That is, immediately before stopping rotation of the sheet feed roller 101, the front part of the sheet reaches the guide rollers 112, 113, and the sheet is fed by the guide rollers 112,113. Further, the pressure from the separation pad 103 to the sheet is temporarily lowered when the paper 102 and separating pad 103 change from contacting the circumferential surface 108 of the feed roller 101 to contacting the collars 110. In this case, the subsequent sheet may also be fed in accordance with the advancing movement of the precedent sheet due to the frictional force between the precedent sheet and a subsequent sheet.

Further, the non circular cross-sectional shape of the feed roller 101, i.e., D-shape in cross-section incurs high material cost, and an entire feed mechanism becomes complicated and causes high production cost.

SUMMARY OF THE INVENTION

In view of the foregoing, it is an object of the present invention to provide a sheet feeder capable of reliably feeding a recording medium one sheet at a time by a feed roller having a circular cross-section.

Another object of the present invention is to provide such sheet feeder capable of avoiding completely overlapped feeding or partly overlapping feeding of the papers.

Still another object of the present invention is to provide such sheet feeder having a simplified construction capable of lowering material cost and production cost.

These and other objects of the present invention will be attained by providing a sheet feeder for feeding each sheet of recording medium including a feed roller, a separating pad, a space forming member, and a support portion. The feed roller includes a cylindrical roller mass for contacting and conveying the sheet of recording medium, and a roller shaft supporting the roller mass and defining an axis. The separating pad opposes the cylindrical outer surface and is urged toward a cylindrical outer surface of the cylindrical roller for interposing the sheet between the separating pad and cylindrical outer surface. The space forming member has a contact portion contacting the sheet and the separating pad for forming a space between the cylindrical outer surface and the sheet and between the cylindrical outer surface and the separating pad against urging force of the separating pad at a predetermined angular rotation range of the feed roller. The space forming member is formed with a center bearing bore. The support portion is provided on the roller shaft and is integrally rotated therewith. The center bearing bore is loosely disposed over the support portion and is partly contacted therewith to provide a first distance between an axis of the rotation shaft and the contact portion greater than the radius of the roller mass at the predetermined angular rotation range of the feed roller.

In another aspect of the invention, there is provided an image forming device including a casing, at least one cassette, the sheet feeder, a pair of guide rollers, an image forming unit and a fixing unit. The casing has at least one cassette accommodating section. The at least one cassette maintains a stack of sheets and is detachably mounted on the at least one cassette accommodating section. The sheet feeder is provided immediately downstream of the at least one cassette, and includes the above described feed roller, separating pad, space forming member, and support portion. The pair of guide rollers are provided immediately downstream of the sheet feeder for conveying each sheet fed by the sheet feeder. The image forming unit is positioned downstream of the pair of guide rollers for forming an image on the sheet fed by the pair of guide rollers. The image forming unit includes a photosensitive drum and a transfer roller in confronting relation to the photosensitive drum. The fixing unit is positioned downstream of the image forming unit for fixing the image on the sheet fed from the image forming unit. The fixing unit includes a heat roller and a pressure roller in contact with the heat roller.

DETAILED DESCRIPTION OF THE PREFERRED EMBODIMENT

Figure 1:
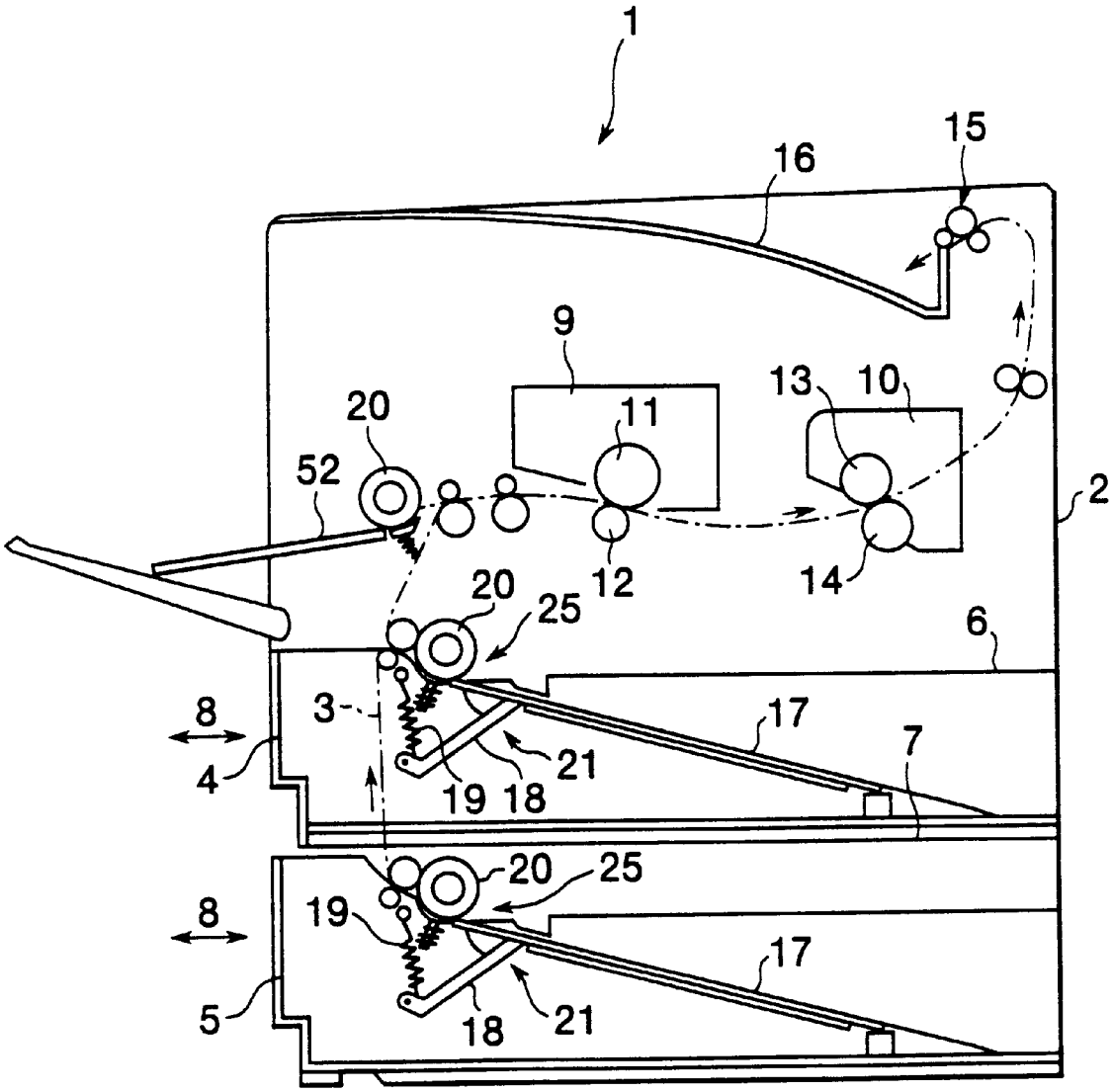
FIG. 1 is a side cross-sectional view showing relevant parts of a laser printer provided with a sheet feeder according to an embodiment of the present invention.

A sheet feeder according to a preferred embodiment of the present invention will be described while referring to FIGS. 1 through 8. FIG. 1 shows a laser printer 1 provided with a sheet feeder according to the embodiment. The laser printer 1 includes a printer casing 2. The lower portion of the printer casing 2 is formed with a first cassette accommodating section 6 and a second cassette accommodating section 7. A first cassette 4 and a second cassette 5 are housed in the first cassette accommodating section 6 and second cassette accommodating section 7, respectively, for maintaining stacks of paper or overhead projector sheets 3. The first cassette 4 and second cassette 5 are capable of sliding freely in and out of the first cassette accommodating section 6 and second cassette accommodating section 7 in a direction indicated by arrows 8. The upper portion of the printer casing 2 is provided with an image forming unit 9 for forming a toner image and transferring the image to the sheet 3, and a fixing unit 10 for fixing a toner image on the sheet 3. The image forming unit 9 is provided with a toner cartridge, a charging device, and the like. The lower portion of the image forming unit 9 is provided with a photosensitive drum 11 and a transfer roller 12 in confronting relation to the photosensitive drum 11. The fixing unit 10 is provided with a heating roller 13 and a pressure roller 14 in contact with the heating roller 13.

Each sheet 3 fed from either the first cassette 4 or the second cassette 5 is conveyed between the photosensitive drum 11 and transfer roller 12, at which time a toner image is transferred to the sheet 3. Subsequently, the sheet 3 is conveyed between the heating roller 13 and pressure roller 14, at which time the transferred toner image is fixed to the sheet 3. Finally, the sheet 3 is discharged by a discharge roller 15 onto a receiving tray 16.

Each of the first cassette 4 and second cassette 5 provided in the bottom section of the printer casing 2 is provided with a receiving plate 17 for receiving the stack of sheets 3. The bottom end of the receiving plate 17 (right side of the diagram) is rotatably supported near the bottom of the each cassette. The front end of the receiving plate 17 (left side of the diagram) is supported by a pivot arm 18. That is, a rear end of the pivot arm 18 is slidably movable with respect to the bottom surface of the front portion of the receiving plate 17. A front end of the pivot arm 18 is rotatably supported at a lower position on the frame of the cassette. An urging spring 19 is fixed between an upper portion on the frame of each cassette 4 (5) and the pivot arm 18, so that the pivot arm 18 is urged to be pivotally moved in a counterclockwise direction about the front pivot end of the pivot arm 18. Thus, the sheets 3 stacked on top of the receiving plate 17 are urged toward a feed roller 20 described later. The receiving plate 17, the pivot arm 18 and the urging spring 19 are all components of a sheet urging device 21.

The feed roller 20 and a separating pad 22 (FIG. 5) opposing the feed roller 20 are provided at the front end side of the receiving plate 17. With this configuration, a sheet 3 from a stack of sheets in either the first cassette 4 or second cassette 5 is interposed between the feed roller 20 and separating pad 22 and conveyed toward the image forming unit 9. The laser printer 1 also includes a manual insertion tray 52 for inserting a sheet of recording material by hand one sheet at a time. A combination of the feed roller 20 and the separating pad 22 is also provided at immediately downstream of the manual insertion tray 52.

Figure 2:
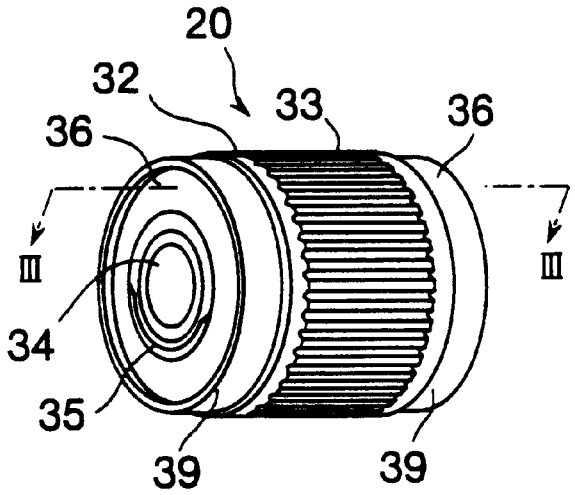
FIG. 2 is a perspective view showing a feed roller of the sheet feeder according to the embodiment of the present invention.
Figure 3:
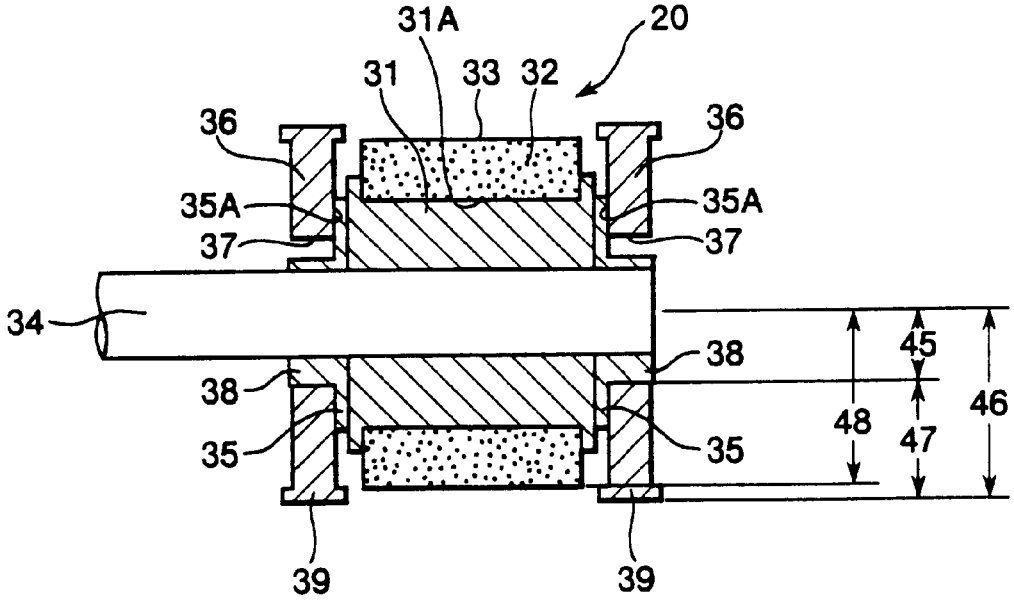
FIG. 3 is a cross-sectional view showing the feed roller taken along the line III—III of FIG. 2.

Next, the feed roller 20 and the separating pad 22 will be described with reference to FIGS. 2 and 3.

The feed roller 20 includes a shaft 34, a core portion 31 provided over the shaft and formed of a resin, and an annular portion 32 disposed over the core portion 31 and made from an elastic material such as rubber that has a high frictional coefficient. The annular portion 32 has a circumferential surface 33 for contacting and conveying the sheet 3. A plurality of grooves are formed in the circumferential surface 33 orthogonal to the conveying direction in order to prevent a slippage of the sheet 3 relative to the circumferential surface 33 during the conveying process. The annular portion 32 is formed in a cylindrical shape with an approximately circular cross-section and is fitted over a peripheral surface 31A of the core 31, which also has an approximately circular cross-section (see FIG. 3). The shaft 34 protrudes outwardly in the axial direction on both sides of the core 31. Support shafts 35 coaxial to the shaft 34 are freely and detachably fitted around the shaft 34.

Collars 36 are loosely and rotatably fitted over the support shafts 35. A peripheral surface 39 is formed on each of the collars 36, making the diameter of the collars 36 larger than the diameter of the circumferential surface 33 of the annular portion 32. The peripheral surface 39 serves as a contact portion in contact with the sheet and the separation pad 22. Each of the collars 36 has a circular hollow center that forms a support hole 37. The support hole 37 is formed concentrically with the collar 36. The collars 36 contact the sheet 3 and separating pad 22 (see FIGS. 5 and 8) to form a space between the circumferential surface 33 of the annular portion 32 and the separating pad 22, preventing the circumferential surface 33 from contacting the sheet 3 and separating pad 22 when the sheet 3 is being conveyed by guide rollers 41, 42 (FIG. 8) provided downstream of the feed roller 20.

As shown in FIGS. 5–8, the separating pad 22 is positioned opposite the feed roller 20, such that the sheet 3 is interposed between the two. The separating pad 22 is made from an elastic material having a frictional coefficient slightly lower than that of the annular portion 32. The separating pad 22 is supported by a separating pad holder 23, and a top portion of the separating pad holder 23 is provided with a sheet receiver portion 24. The separating pad 22 is embedded into a depression formed in the top surface of the sheet receiver portion 24. In each of the first cassette accommodating unit 6 and second cassette accommodating unit 7, the separating pad holder 23 is urged toward the feed roller 20 by a spring (not shown) or the like interposed between a position-fixing stop member (not shown) provided at a fixed position of the cassette accommodating unit and the bottom surface of the sheet receiver portion 24. Accordingly, the separating pad 22 is also urged by the spring, the stop member, and the separating pad holder 23 toward the feed roller 20. A combination of the spring, the stop member and the separating pad holder 23 serves as separation pad urging means.

The guide rollers 41 and 42 are disposed on the downstream side of the feed roller 20 for conveying the sheet 3 fed by the feed roller 20 toward the image forming unit 9. That is, the sheet 3 fed by the feed roller 20 enters between the guide rollers 41 and 42, and the rotation of the guide rollers 41 and 42 convey the sheet 3 toward the image forming unit 9.

Figure 4:
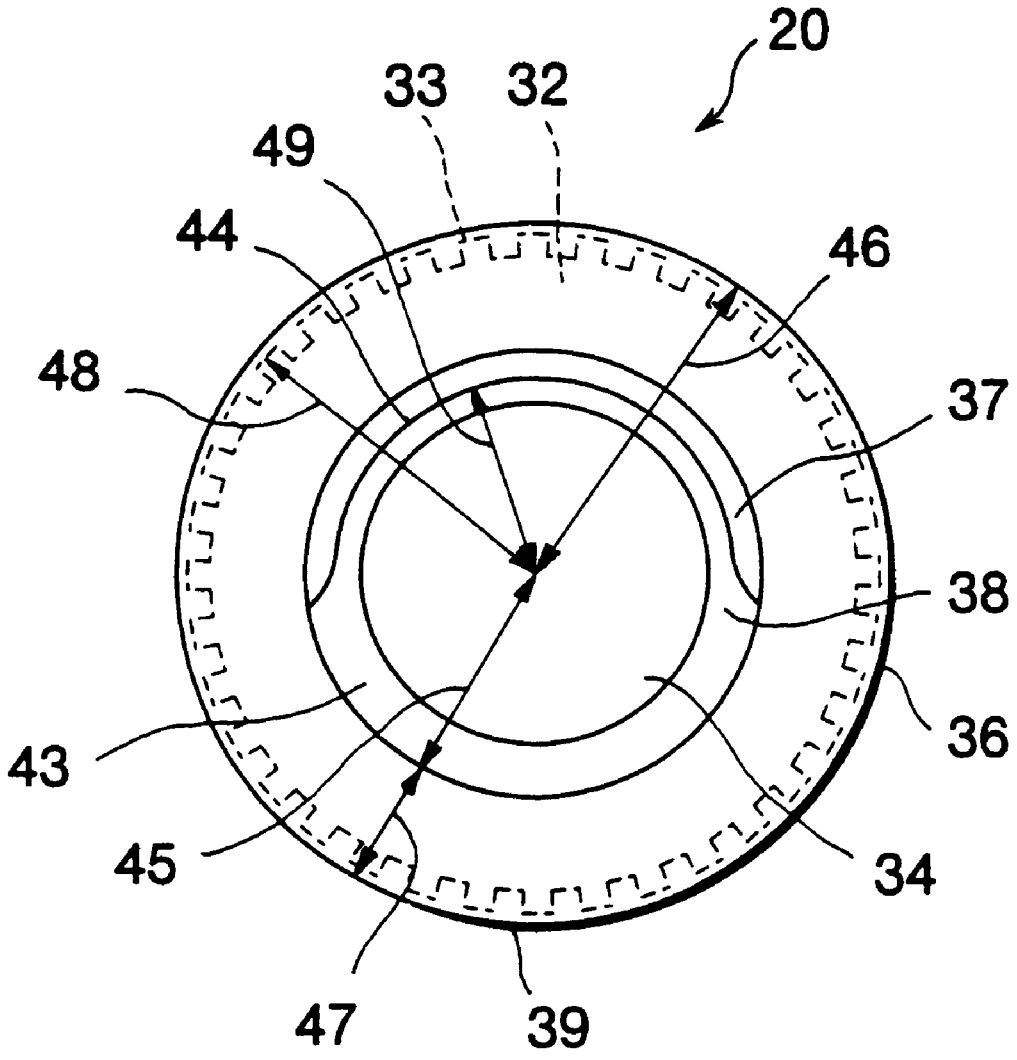
FIG. 4 is a schematic side view showing the feed roller according to the embodiment.

Each support shaft 35 is mounted on the shaft 34 in such a manner that its angular position relative to the shaft 35 is fixed, and can be rotated together with the rotation of the shaft 34. As shown in FIGS. 3 and 4, the support shaft 35 has a flange portion 35A and an irregular radius sleeve portion 38. The flange portion 35A is positioned in contact with each end surface of the core 31. The irregular radius sleeve portion 38 is adapted for temporarily forming a gap between the circumferential surface 33 and sheet 3 and the circumferential surface 33 and separating pad 22 when the peripheral surfaces 39 of the collars 36 contact the sheet 3 and the separating pad 22. The irregular radius sleeve portion 38 is positioned over the shaft 34 in order to contact the inner surface of the support hole 37 formed in the collar 36.

The irregular radius sleeve portion 38 includes a first radius portion 43 and a second radius portion 44 slightly smaller than the first radius portion 43. The first and second radius portions 43 and 44 are positioned a diametrially opposite sides to each other. A radius 45 of the first radius portion 43 is equivalent to the difference between a radius 46 of the peripheral surface 39 and a distance 47 from the peripheral surface 39 to the support hole 37. The radius 46 of the peripheral surface 39 is formed larger than the radius 48 of the circumferential surface 33. Further, the support holes 37 of the collars have a radius approximately equivalent to the radius of the first radius portion 43. When the first radius portion 43 is in contact with the inner surface of the support hole 37, there is play (a gap) between the second radius portion 44 and the inner surface of the support hole 37.

The difference between the radius 45 of the first radius portion 43 and the radius 49 of the second radius portion 44 is greater than "A" plus "B" where "A" is a difference between the radius 46 of the peripheral surface 39 and the radius 48 of the circumferential surface 33, and "B" is radial deformation amount of the circumferential surface 33 due to pressure from the separating pad 22.

Accordingly, when the first radius portion 43 opposes the separating pad 22, the pressure from the separating pad 22 forces the first radius portion 43 to contact the inner surface of the support hole 37, and the length from the axial center of the roller shaft 34 to the peripheral surface 39 of the collar 36 is approximately equal to the radius 46 of the peripheral surface 39 (as shown in FIG. 4). Further, since the radius 49 of the second radius portion 44 is smaller than the radius 45 of the first radius portion 43, when the second radius portion 44 opposes the separating pad 22, force from the separating pad 22 causes the second radius portion 44 to move toward the inner surface of the support hole 37. Accordingly, the length from the axial center of the roller shaft 34 to the peripheral surface 39 of the collar 36 can be made shorter than the radius 48 of the circumferential surface 33 (refer to FIG. 6).

As a result, when the first radius portion 43 of the irregular radius sleeve portion 38 opposes the separating pad 22, a gap is formed between the circumferential surface 33 and the sheet 3 by pressure from the separating pad 22. Further, when the second radius portion 44 opposes the separating pad 22, pressure from the separating pad 22 can move the collar 36 upwardly by the radial gap length between the inner peripheral surface of the support hole 37 and the outer peripheral surface of the second radius portion 44. Thus, the sheet 3 can be nipped between the circumferential surface 33 of the annular portion 32 and the separating pad 22.

The sheet feeder 25 is constructed with the above-described feed roller 20, collar 36, separating pad 22, and the like. By integrating these parts, it is possible to accurately and reliably feed the sheet 3. Next, the process of conveying the sheet 3 with the sheet feeder 25 will be described with reference to FIGS. 5–8.

Figure 8:
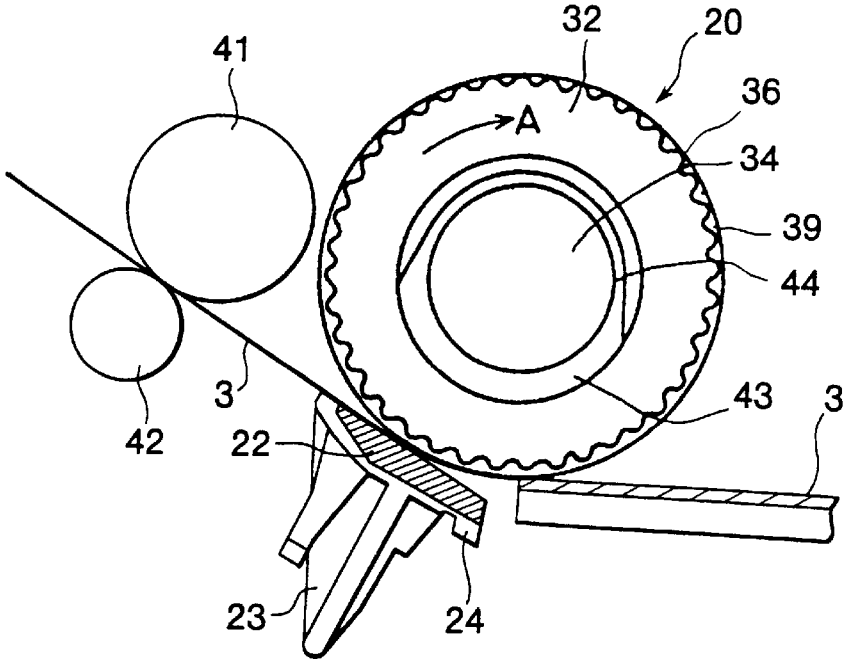
FIG. 8 is an explanatory drawing showing the state of the feed roller when conveyance of the sheet of recording medium is complete and the feed roller is waiting to convey a next sheet.

Prior to the sheet feeding operation, the first radius portion 43 is positioned in opposition to the separating pad 22 as shown in FIG. 8. In this state, the sheets 3 stacked in the cassettes 4 and 5 are positioned near the upstream side of the feed roller 20 via the sheet urging device 21.

For starting the sheet feeding operation, the first radius portion 43 moves away from a position opposing the separating pad 22 as the feed roller 20 rotates in the clockwise direction (shown by an arrow A in the diagram). Thus, the sheet 3 is fed between the feed roller 20 and the separating pad 22.

Figure 5:
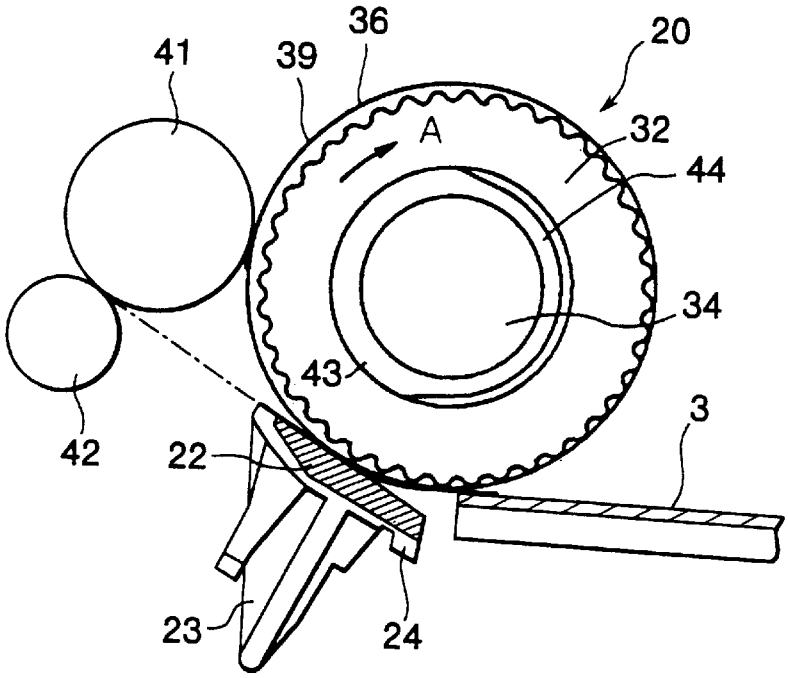
FIG. 5 is an explanatory drawing showing the state of the feed roller when a sheet of recording medium initially contacts the feed roller.

As the sheet 3 enters between the feed roller 20 and the separating pad 22, the first radius portion 43 is moved away from the position in opposition to the separating pad 22, and instead, the second radius portion 44 is moved toward the position in opposition to the separating pad. 22 as shown in FIG. 5. Because the gap is formed between the inner peripheral surface of the support hole 37 and the outer peripheral surface of the second radius portion 44, the collar 36 can be lifted upwardly by the urging force from the separating pad 22. Therefore, the sheet 3 is brought into contact with the circumferential surface 33 of the annular portion 32.

That is, up to the moment the sheet 3 contacts the circumferential surface 33, the two collars 36 continue to receive and oppose the pressure from the separating pad 22. However, from the moment the sheet 3 contacts the circumferential surface 33, the circumferential surface 33 receives the pressure from the separating pad 22, and the sheet 3 is interposed between the two. In this state, the distance from the axial center of the roller shaft 34 to the contact portion, i.e., at the lower surface portion of the collar 36, becomes equal to or can be less than the radius 48 of the circumferential surface 33. On the other hand, when the inner surface of the support hole 37 contacts the first radius portion 43, the distance from the axial center of the roller shaft 34 to the sheet contacting point of the peripheral surfaces 39 the collar 36 is greater than the radius 48 of the circumferential surface 33. Therefore, the position at which the peripheral surface 39 contacts the separating pad 22 is lower than the position at which the circumferential surface 33 contacts the sheet 3 and separating pad 22.

Accordingly, during the transition from the state at which the collars 36 contact the sheet 3 and separating pad 22 to the state in which the circumferential surface 33 comes in contact with the sheet 3 and separating pad 22, the separating pad 22 gradually moves upward an amount only equal to the difference between the radius 46 and the radius 48. Hence, by decreasing the difference between the radius 46 and the radius 48. the amount the separating pad 22 moves upward and downward can be decreased. In the depicted embodiment, the radius 46 is only approximately 0.2 mm greater than radius 48. With this arrangement, the separating pad 22 moves smoothly upward, and therefore, feeding of doubles that can be caused by abrupt upward and downward movement of the separating pad 22 can be prevented, allowing the sheet 3 to be fed one sheet at a time.

Figure 6:
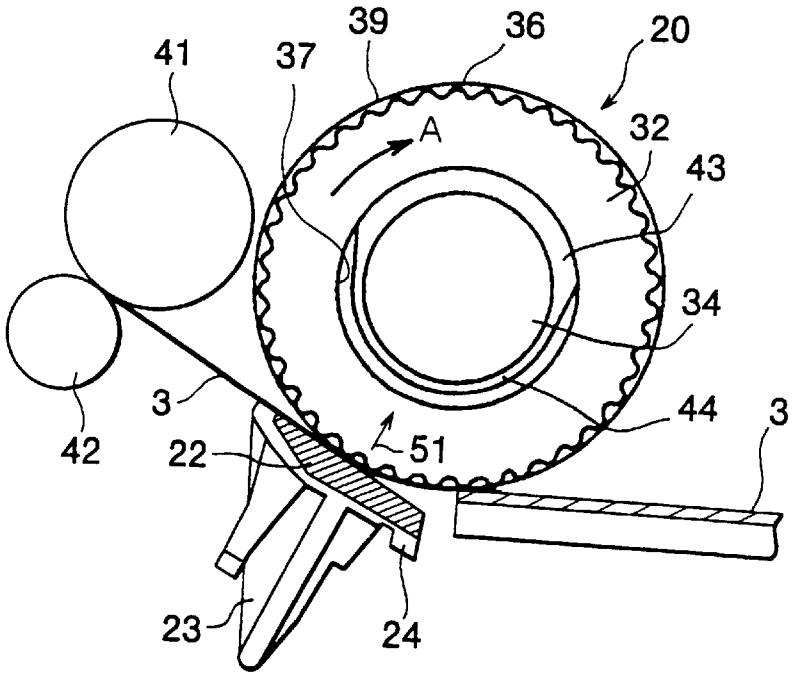
FIG. 6 is an explanatory drawing showing the state of the feed roller as the feed roller conveys the sheet of recording medium.

Next, as shown in FIG. 6, as the roller shaft 34 rotates in the clockwise direction, the sheet 3 contacts the circumferential surface 33 of the feed roller 20 and is fed between the guide rollers 41 and 42. At this time, the separating pad 22 applies pressure to the circumferential surface 33 and, presses the circumferential surface 33 inward in the direction indicated by the arrow 51, because the circumferential surface 33 is made from the elastic material such as rubber. Thus, the circumferential surface 33 is radially inwardly deformed. At the same time, the second radius portion 44 is opposite the separating pad 22, allowing the collar 36 to move freely in the direction of the arrow 51. Still, the peripheral surface 39 remains in constant contact with the sheet 3 due to the force of its own weight. However, the collars 36 do not positively apply any pressure to the sheet 3 and, therefore, do not obstruct the sheet conveying process. Since the difference between the radius 45 of the first radius portion 43 and the radius 49 of the second radius portion 44 is greater than the sum of the difference between the radius 46 of the peripheral surface 39 and the radius 48 of the circumferential surface 33 plus radial deformation amount of the circumferential surface 33, as described above, even when the pressure of the separating pad 22 causes the circumferential surface 33 to deform in the radial direction, the peripheral surfaces 39 of the collars 36 will not positively apply pressure to the sheet 3. As a result, the sheet 3 can be reliably conveyed.

Figure 7:
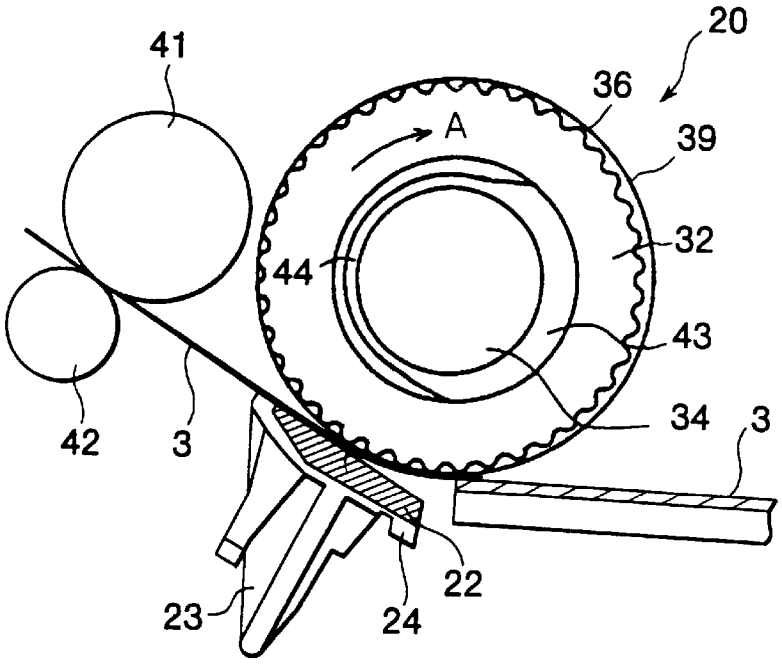
FIG. 7 is an explanatory drawing showing the state of the feed roller as the sheet of recording medium separates from the feed roller.

Next, as shown in FIG. 7, at the moment the sheet 3 separates from the circumferential surface 33 of the annular portion 32, the pressure from the separating pad 22 that was received and opposed by the circumferential surface 33 begins to be received by the peripheral surfaces 39 of the annular portion 32, as the roller shaft 34 rotate in the clockwise direction. However, at the same time, the inner surface of the support hole 37, which surface had been opposing or contacting the second radius portion 44 until now, is forced to contact the first radius portion 43 by pressure from the separating pad 22. Since the radius 46 of the peripheral surface 39 is greater than the radius 48 of it the circumferential surface 33, the separating pad 22 is gradually pushed downward. Accordingly, during the transition from the state at which the annular portion 32 contacts the sheet 3 and separating pad 22 to the state in which the collars 36 contact the sheet 3 and separating pad 22, there is no bump caused by a difference in level and the separating pad 22 moves smoothly downward. As a result, feeding of doubles that can be caused by upward and downward movement of the separating pad 22 can be prevented, allowing the sheet 3 to be reliably fed one sheet at a time.

Next, as shown in FIG. 8, the feed roller 20 has rotated in the clockwise direction until the first radius portion 43 is in a position opposite the separating pad 22 and has stopped in that position. The sheet 3 is conveyed toward the image forming unit 9 by the rotation of the guide rollers 41 and 42. Although the sheet 3 receives pressure from the separating pad 22 at this time, the top surface of the sheet 3 is contacted by the rotating peripheral surface 9 of the collar 36. Therefore, a prescribed space can be maintained between the sheet 3 and the circumferential surface 33 of the annular portion 32, and the sheet 3 can be reliably conveyed by the guide rollers 41 and 42.

In the sheet feeder 25 of the present embodiment described above, when the sheet 3 enters beneath the feed roller 20 and when the sheet 3 separates from the feed roller 20, the separating pad 22 moves smoothly upward and downward, effectively preventing double sheets and overlapping sheets from being conveyed. Hence, the sheet 3 can be reliably conveyed one sheet at a time.

Further, by mounting the collars 36 on the support shafts 35, which are coaxial with the roller shaft 34, when the first radius portion 43 is positioned opposing the separating pad 22, a prescribed gap can be formed between the circumferential surface 33 of the annular portion 32 and both the sheet 3 and the separating pad 22. Further, when the second radius portion 44 is positioned opposite the separating pad 22, the circumferential surface 33 contacts both the sheet 3 and the separating pad 22. Accordingly, the cross-section of the annular portion 32 and the cross-section of the peripheral surface 31A of the core 31 can be formed in an approximately circular shape, thereby simplifying construction of the annular portion 32, core 31, and roller shaft 34 and reducing material and production costs.

Figure 9:
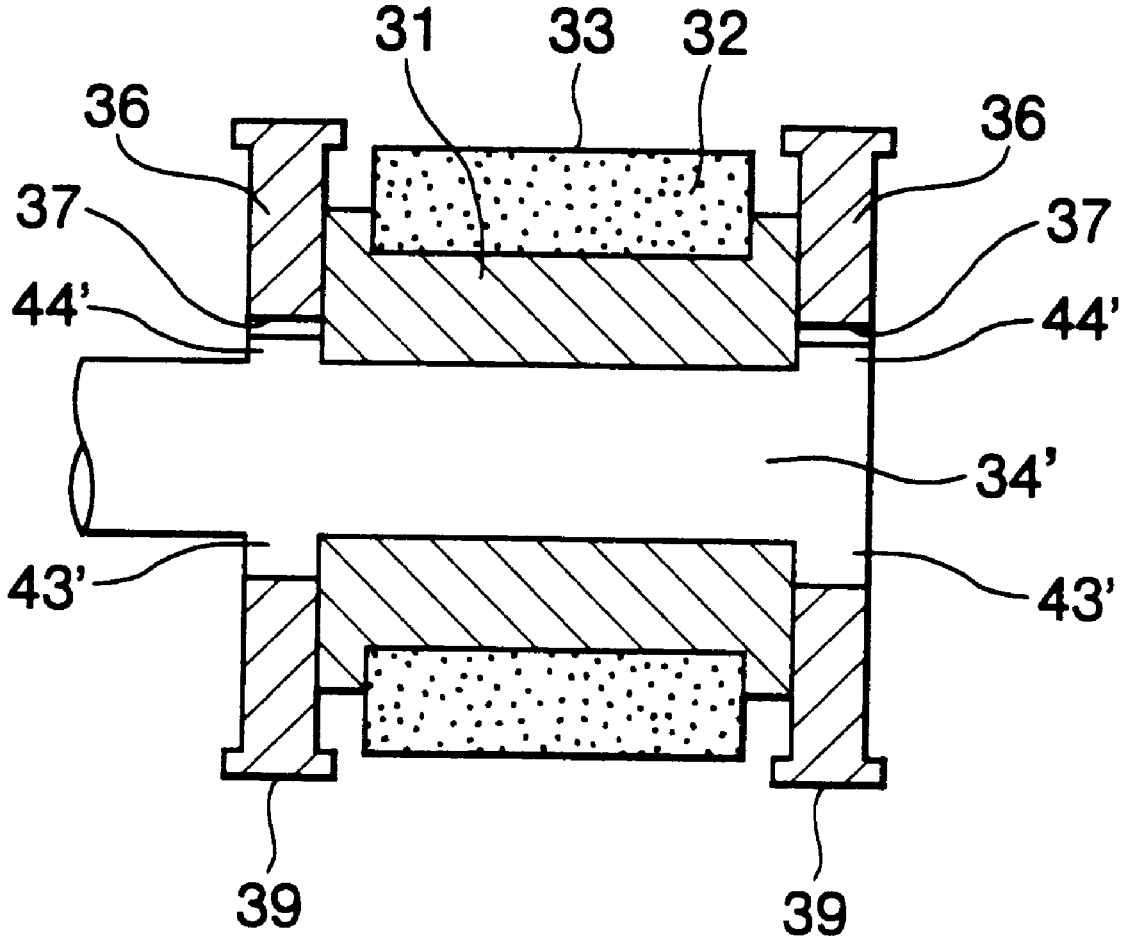
FIG. 9 is a cross-sectional view showing a feed roller according to a modified embodiment.
Figure 10:
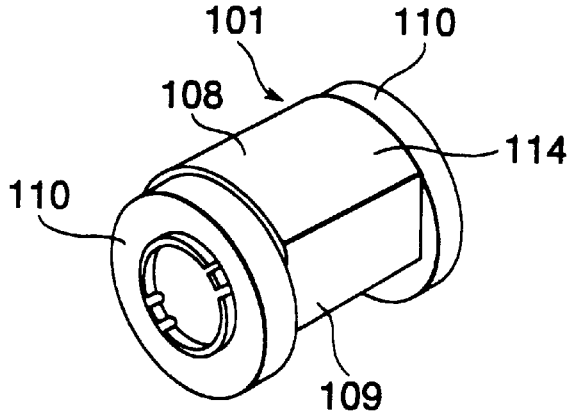
FIG. 10 PRIOR ART
FIG. 10 is a perspective view showing a sheet feed roller and a pair of rollers according to a conventional device.
Figure 11:
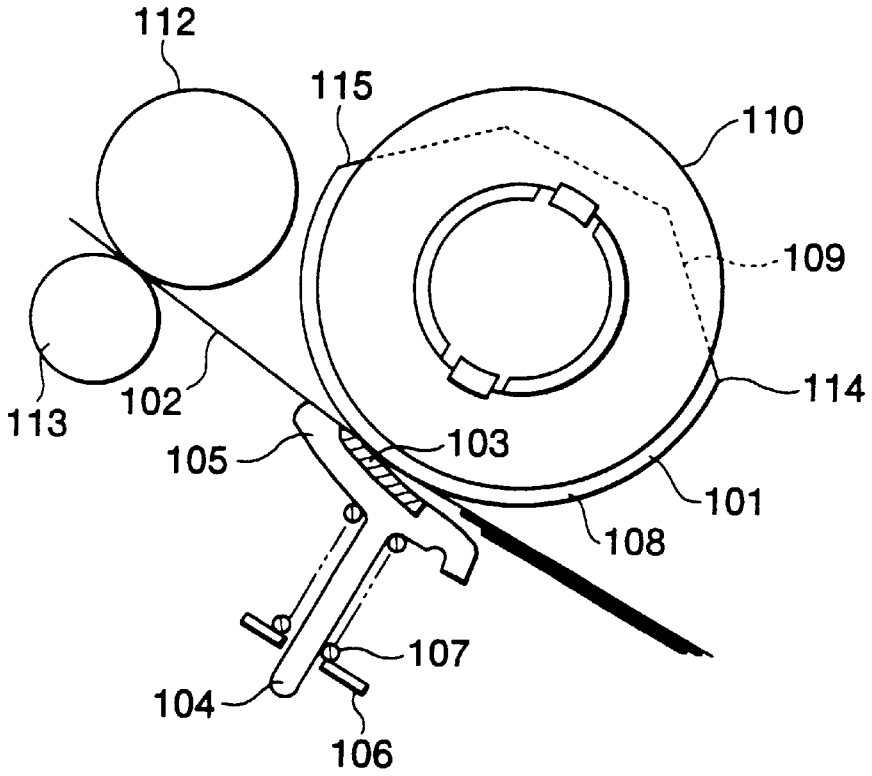
FIG. 11 PRIOR ART
FIG. 11 is an explanatory drawing showing the state of the conventional feed roller as the feed roller conveys the sheet of recording medium.

FIG. 9 shows a feed roller according to a modified embodiment. In the first embodiment, two collars 36 are mounted on the irregular sleeve portions 38 of the support shaft 35 which is detachably mounted on the roller shaft 34. However, it is also possible to provide the irregular portions 38' directly on the roller shaft 34' and mount the two collars 36 on the irregular portion 38'. The irregular portion 38' has a larger radius portion 43' and a smaller radius portion 44' corresponding to the first and second radius portions 43, 44, respectively of the first embodiment.

While the invention has been described in detail and with reference to the specific embodiment thereof, it would be apparent to those skilled in the art that various changes and modifications may be made therein without departing from the spirit and scope of the invention. For example, it is not particularly essential to use the two collars 36, provided that the space forming member is capable of providing a space between the annular portion 32 and the sheet 3 and the separating pad 22.

What is claimed is:

1. A sheet feeder for feeding each sheet of recording medium comprising:

a feed roller comprising a cylindrical roller mass having a cylindrical outer surface that contacts and conveys each sheet of recording medium the cylindrical outer surface having a radius; and a roller shaft supporting the roller mass and defining an axis, the radius being defined between the axis and the cylindrical outer surface a separating pad opposing the cylindrical outer surface and urged toward the cylindrical outer surface for interposing the sheet, being nipped, between the separating pad and cylindrical outer surface;

a space forming member having a contact portion contacting the sheet and the separating pad, the space forming member being formed with a center bearing bore; and having a circular shape with a radius greater than the radius of the cylindrical outer surface of the roller mass, and a support portion provided on the roller shaft and integrally rotated therewith, the center bearing bore being loosely disposed over the support portion and partly contacted therewith to provide a first distance between the axis of the rotation shaft and the contact portion greater than the radius of the roller mass at a predetermined angular rotation range of the feed roller a space being formed between the cylindrical outer surface and the sheet and between the cylindrical outer surface and the separating pad against the urging force of the separating pad toward the cylindrical outer surface at the predetermined angular rotation range of the feed roller for preventing the sheet from being nipped and feed between the cylindrical outer surface and the separating pad.

2. The sheet feeder as claimed in claim 1, wherein the center bore defines an inner peripheral surface, wherein the roller shaft has a uniform diameter along its length and the support portion is provided separately from the roller shaft by having a sleeve portion disposed over the roller shaft.

3. The sheet feeder as claimed in claim 2, wherein the center bore of the space forming member has a diameter greater than a diametrical length of the sleeve portion;

and wherein the sleeve portion has a first radius portion having a first radius portion, and a second radius portion having a second radius smaller than the first radius and positioned diametrically opposite to the first radius portion, the first radius being equivalent to a difference between the radius of the space forming member and a distance between the contact portion and a portion of the inner peripheral surface of the center bore, the portion being in contact with the first radius portion.

4. The sheet feeder as claimed in claim 3, wherein the first radius portion is positioned in coincidence with the predetermined angular rotation range of the feed roller.

5. The sheet feeder as claimed in claim 4, wherein a difference between the first radius and the second radius is greater than a difference between the radius of the space forming member and the radius of the cylindrical outer surface of the roller mass.

6. The sheet feeder as claimed in claim 5, wherein the roller mass is formed of an elastic material providing a radial deformation in a radial direction thereof upon pressure contact with the recording medium;

and wherein the difference between the first radius and the second radius is greater than a sum of the difference between the radius of the space forming member and the radius of the cylindrical outer surface of the roller mass plus the radial deformation amount of the roller mass.

7. The sheet feeder as claimed in claim 6, wherein the roller shaft extends through the roller mass and protrudes from each end of the roller mass;

and wherein the support portion comprises a pair of support members each disposed on each protruded portion of the roller shaft;

and wherein the space forming member comprises a pair of collars each disposed on each support member.

8. The sheet feeder as claimed in claim 1, wherein the space forming member has a circular shape whose radius is greater than the radius of the cylindrical outer surface of the roller mass, the center bore defining an inner peripheral surface;

and wherein the support portion is provided integrally with roller shaft.

9. The sheet feeder as claimed in claim 8, wherein the center bore of the space forming member has a diameter greater than a diametrical length of the support portion;

and wherein the sleeve portion has a first radius portion having a first radius portion, and a second radius portion having a second radius smaller than the first radius and positioned diametrically opposite to the first radius portion, the first radius being equivalent to a difference between the radius of the space forming member and a distance between the contact portion and a portion of the inner peripheral surface of the center bore, the portion being in contact with the first radius portion.

10. The sheet feeder as claimed in claim 9, wherein the first radius portion is positioned in coincidence with the predetermined angular rotation range of the feed roller.

11. The sheet feeder as claimed in claim 10, wherein a difference between the first radius and the second radius is greater than a difference between the radius of the space forming member and the radius of the cylindrical outer surface of the roller mass.

12. The sheet feeder as claimed in claim 11, wherein the roller mass is formed of an elastic material providing a radial deformation in a radial direction thereof upon pressure contact with the recording medium;

and wherein the difference between the first radius and the second radius is greater than a sum of the difference between the radius of the space forming member and the radius of the cylindrical outer surface of the roller mass plus the radial deformation amount of the roller mass.

13. The sheet feeder as claimed in claim 12, wherein the roller shaft extends through the roller mass and protrudes from each end of the roller mass;

and wherein the support portion comprises a pair of irregular diameter portions each disposed integrally on each protruded portion of the roller shaft;

and wherein the space forming member comprises a pair of disc members each disposed on each irregular diameter portion.

14. The sheet feeder as claimed in claim 1, wherein the cylindrical outer surface is formed with a plurality of grooves each extending in an axial direction of the roller shaft.

15. The sheet feeder as claimed in claim 1, wherein the separation pad comprises:

a pad holder movable in a radial direction of the feed roller;

a pad member fixed on the pad holder and in contact with the sheet and the space forming member, the pad member being made of an elastic material; and a biasing member connected to the pad holder to urge the pad holder toward the feed roller.

16. The sheet feeder as claimed in claim 15, wherein the roller mass provides a friction coefficient higher than that of the pad member.

17. An image forming device comprising:

a casing having at least one cassette accommodating section;

at least one cassette maintaining a stack of sheets and detachably mounted on the at least one cassette accommodating section;

a sheet feeder provided immediately downstream of the at least one cassette, the sheet feeder comprising a feed roller comprising a cylindrical roller mass having a radius and a cylindrical outer surface that contacts and conveys each sheet of recording medium the cylindrical outer surface having a radius; and a roller shaft supporting the roller mass and defining an axis a radius being defined between the axis and the cylindrical outer surface;

a separating pad opposing the cylindrical surface and urged toward the cylindrical outer surface the sheet being nipped between the separating pad and cylindrical outer surface;

a space forming member having a contact portion contacting the sheet and the separating pad, the forming member being formed with a center bearing bore; and having a circular shape with a radius greater than the radius of the cylindrical outer surface of the roller mass a support portion provided on the roller shaft and integrally rotated therewith, the center bearing bore being loosely disposed over the support portion and partly contacted therewith to provide a first distance between the axis of the rotation shaft and the contact portion greater than the radius of the roller mass at the predetermined angular rotation range of the feed roller a space being formed between the cylindrical outer surface and the sheet and between the cylindrical outer surface and the separating pad against the urging force of the separating pad toward the cylindrical outer surface at the predetermined angular rotation range of the feed roller for preventing the sheet from being nipped and feed between the cylindrical outer surface and the separating pad;

a pair of guide rollers provided immediately downstream of the sheet feeder for conveying each sheet fed by the sheet feeder;

an image forming unit positioned downstream of the pair of guide rollers for forming an image on the sheet fed by the pair of guide rollers, the image forming unit comprising a photosensitive drum and a transfer roller in confronting relation to the photosensitive drum; and a fixing unit positioned downstream of the image forming unit for fixing the image on the sheet fed from the image forming unit, the fixing unit comprising a heat roller and a pressure roller in contact with the heat roller.

18. The image forming device as claimed in claim 17, further comprising;

a manual sheet insertion section provided between the pair of guide rollers and the image forming unit for manually inserting a sheet into the casing and toward the image forming unit; and another sheet feeder provided immediately downstream of the manual sheet insertion section, the another sheet feeder providing an arrangement identical with the sheet feeder.

* * * * *